US005425560A

United States Patent [19]

Andersen et al.

[11] Patent Number: 5,425,560

[45] Date of Patent: Jun. 20, 1995

[54] SQUEEZE LATCH

[75] Inventors: Glenn W. Andersen, Burlington; Wayne G. Farvour, Colgate, both of Wis.

[73] Assignee: Strattec Security Corporation, Milwaukee, Wis.

[21] Appl. No.: 230,820

[22] Filed: Apr. 21, 1994

[51] Int. Cl.[6] ..... E05D 15/22

[52] U.S. Cl. ..... 292/163; 292/146

[58] Field of Search ..... 292/163, 175, 153, 145, 292/146, DIG. 63

[56] References Cited

U.S. PATENT DOCUMENTS

| | | | |
|---|---|---|---|
| 2,424,642 | 7/1947 | Towne et al. | 206/1.5 |
| 3,371,511 | 3/1968 | Atkinson | 70/71 |
| 3,464,240 | 9/1969 | Brody et al. | 70/71 |
| 3,909,051 | 9/1975 | Nakai | 292/166 |
| 4,121,863 | 10/1978 | Lawrence | 292/175 |
| 4,183,565 | 1/1980 | Alleman | 292/163 |
| 4,223,787 | 9/1980 | Lowry et al. | 206/387 |
| 4,669,765 | 6/1987 | Ullman | 292/175 |
| 4,793,100 | 12/1988 | Harding et al. | 49/394 |
| 4,837,975 | 6/1989 | Simpson | 49/175 |
| 5,042,854 | 8/1991 | Huang | 292/175 |
| 5,096,240 | 3/1992 | Schultz | 292/153 |

*Primary Examiner*—Peter M. Cuomo
*Assistant Examiner*—Monica E. Millner
*Attorney, Agent, or Firm*—Andrus, Sceales, Starke & Sawall

[57] ABSTRACT

A latch assembly for actuating a bolt assembly for a door is provided. The latch assembly includes a housing and a cavity extending partially therein. The housing includes a guide track for receipt of track engaging members extending from a slider. The slider is movable between a first position whereby the bolt assembly is actuated and a second position whereby the bolt assembly is not actuated.

18 Claims, 5 Drawing Sheets

SQUEEZE LATCH

BACKGROUND OF THE INVENTION

This invention relates to a latch, and in particular, to a squeezable latch for a glove compartment.

Most vehicles include a glove compartment which may be used to hold various items such as gloves, maps and the like. The door of the glove compartment is movable between a first closed position wherein access to the interior of the glove compartment is denied and a second opened position wherein access to the interior of the glove compartment is allowed. The glove compartment door includes a bolt assembly which maintains the door of the glove compartment in the closed position. A latch is used to actuate the bolt assembly and release the door of the glove compartment such that the door may be moved to the opened position.

Heretofore, latches have taken on many different configurations. Prior squeeze latches have included a housing with a pair of sliders extending from opposite ends. A user squeezes the sliders towards the interior of the housing so as to actuate the bolt assembly to release the door of the glove compartment. While these types of squeeze latches are operational, assembly of these types of latches is difficult. Numerous component parts must be assembled in order to construct these prior squeeze latches. Many of these parts are small which adds to the difficulty in assembly.

Therefore, it is a primary object and feature of the present invention to provide a squeeze latch which has few component parts.

It is a further object and feature of the present invention to provide a squeeze latch which is easy to assemble and to manufacture.

It is a still further object and feature of the present invention to provide a squeeze latch which is easy to operate and inexpensive to manufacture.

In accordance with the present invention, a squeeze latch is provided for actuating a bolt assembly for a glove compartment door. The squeeze latch includes a housing having a cavity extending partially therein. Guide tracks extend along a wall of the housing. A slider partially extends into the cavity of the housing. The slider is maintained within the housing by first and second projections which extend from the slider and snap fit into the guide track.

The slider is slidable along the guide tracks between a first non-actuating position and a second actuating position. A spring biases the slider toward the first non-actuating position. In operation, the user presses the slider against the bias of the spring toward the second actuating position. As the slider approaches the second actuating position, the bolt assembly releases the glove compartment door so as to allow the door to be opened and to allow access to the interior of the glove compartment. When the user releases the slider, the spring biases the slider to the non-actuating position so as to reset the bolt assembly. When the glove compartment door is closed, the bolt assembly maintains the door in the closed position.

BRIEF DESCRIPTION OF THE PREFERRED EMBODIMENT

DETAILED DESCRIPTION OF THE PREFERRED EMBODIMENT

Figure 2:
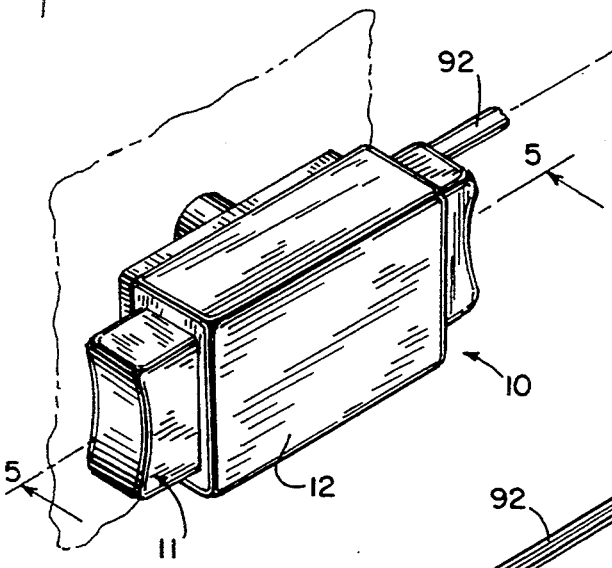
FIG. 2 is an exploded isometric view of the latch assembly of FIG. 1.
Figure 2:
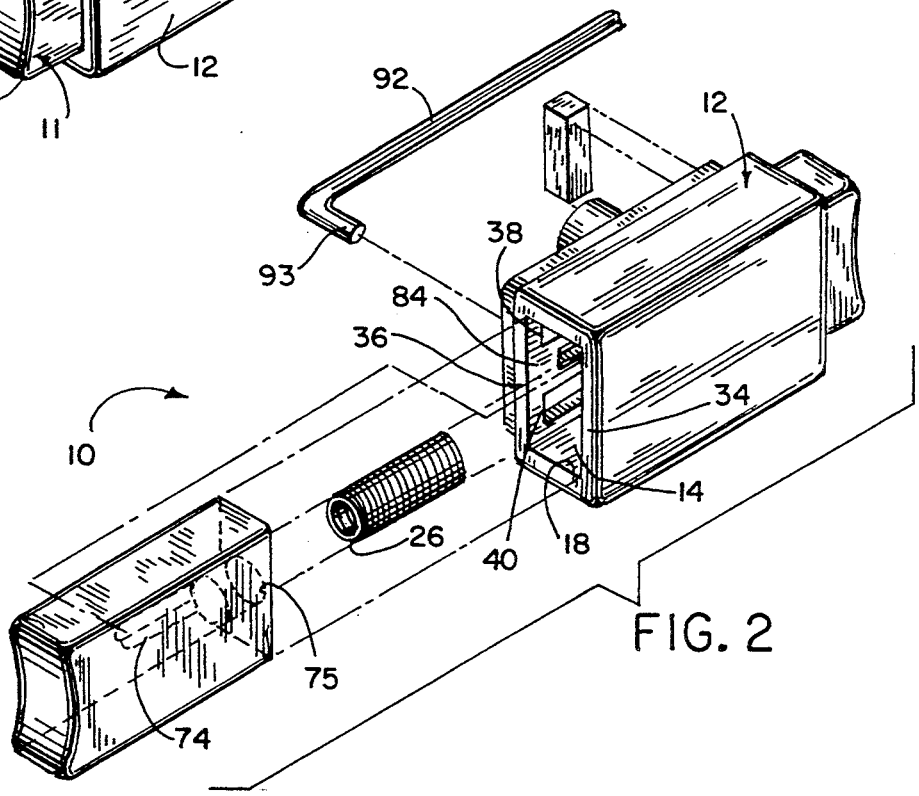
Figure 3:
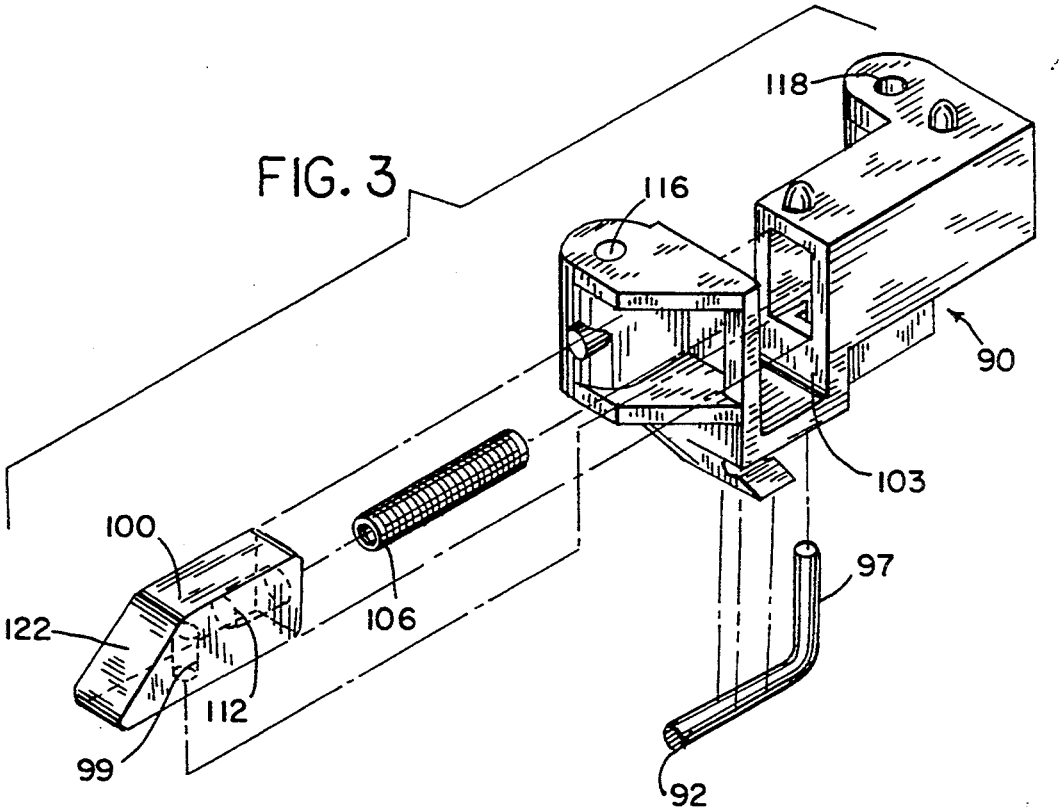
FIG. 3 is an exploded isometric view of the bolt assembly of FIG. 1.
Figure 7:
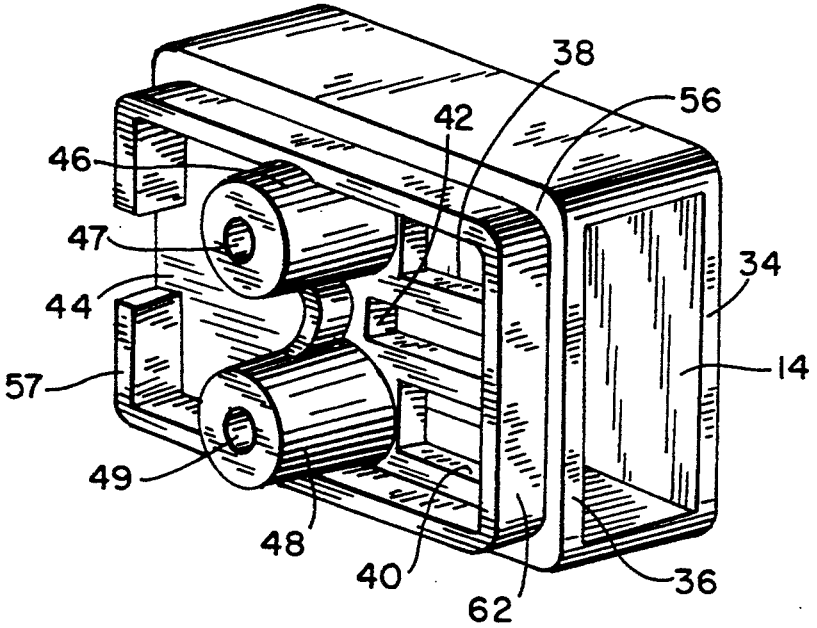
FIG. 7 is an isometric view of the housing of the latch assembly of FIG. 1.

The latch assembly of the present invention is generally designated by the reference number 10. Referring to FIGS. 2, 7, the latch assembly 10 includes a slider 11 and a housing 12 which is generally rectangular in shape and includes a cavity 14 extending partially therethrough for receipt of slider 11.

Figure 5:
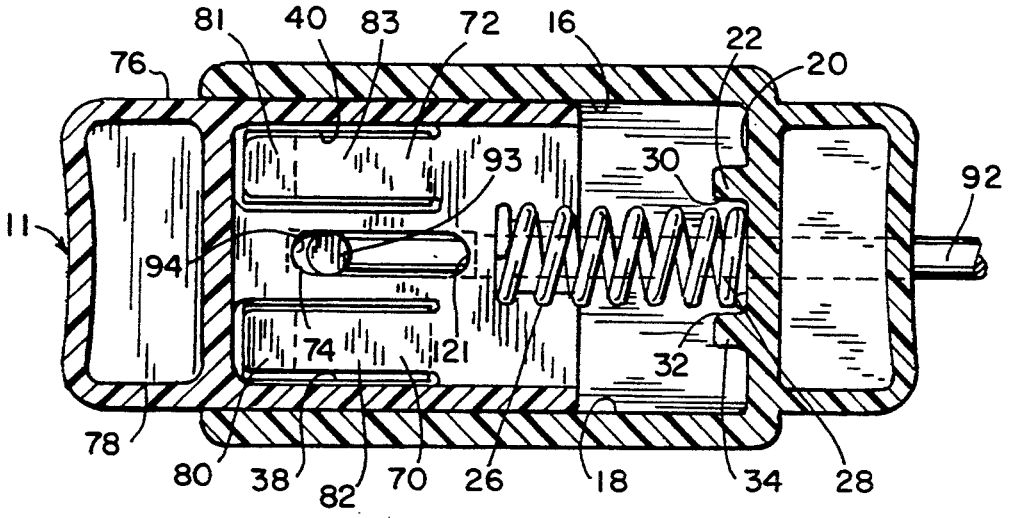
FIG. 5 is a sectional view of the latch assembly of the present invention taken along 5—5 of FIG. 1.

Cavity 14 is defined by first and second inner surfaces 16, 18, FIG. 5, and an end surface 20. End surface 20 includes a pair of projections 22, 24 extending therefrom. Projections 22, 24 are spaced along surface 20 by a spring receipt surface 28 so as to accommodate a spring 26. Each projection 22, 24 includes a shoulder portion 30, 32, respectfully, which prevents lateral movement of spring 26 along surface 20 when latch assembly 10 is assembled.

Referring to FIGS. 2, 7, first and second opposing surfaces 16, 18 within housing 12 are interconnected by a pair of sidewalls 34, 36. Sidewall 36 includes three parallelly extending slots 38, 40, 42, as hereinafter described. Extending from the rear surface 44 of sidewall 36 is a pair of screw receiving members 46, 48, having a screw receipt aperture 47, 49, respectfully, therein.

Figure 4:
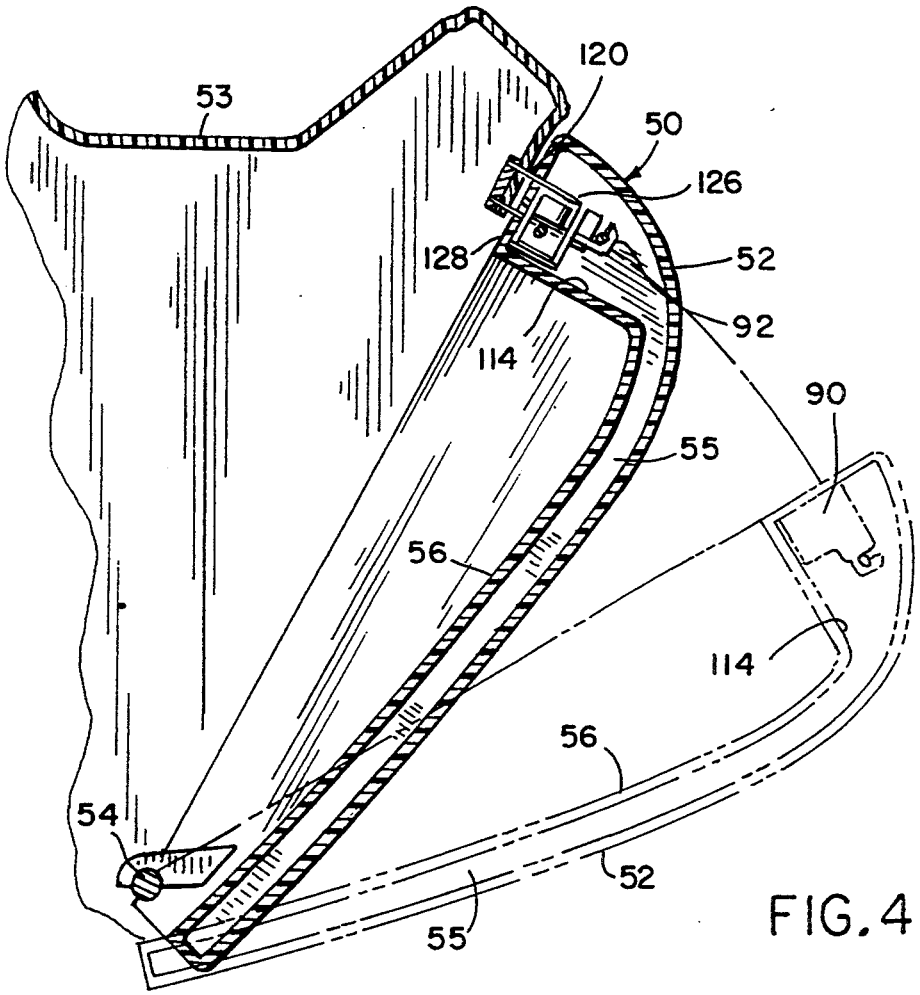
FIG. 4 is a cross sectional view of a portion of a glove compartment incorporating the bolt assembly of FIG. 1.
Figure 9:
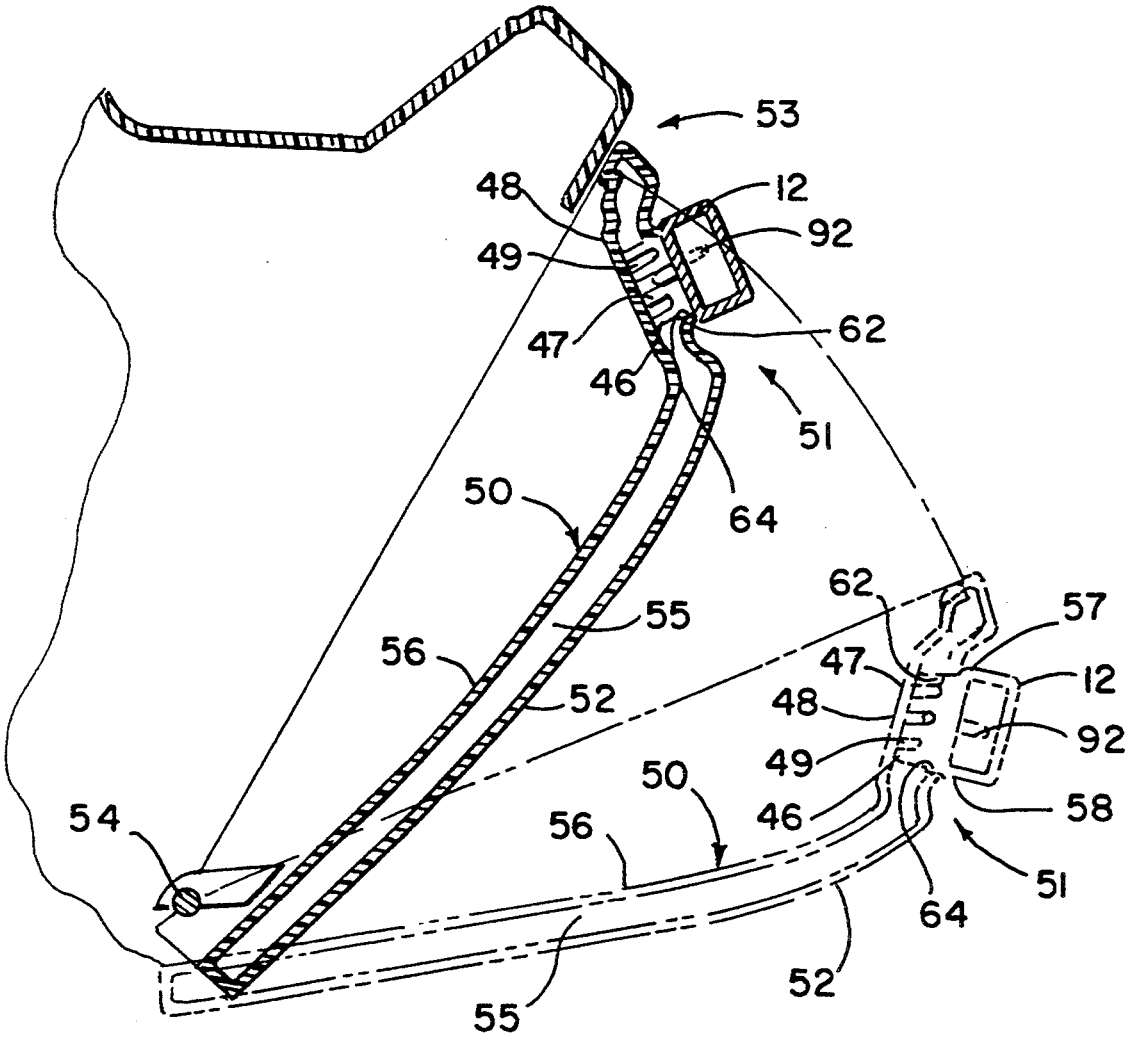
FIG. 9 is a cross sectional view of a portion of a glove compartment incorporating the latch assembly of FIG. 1.

As best seen in FIG. 9, housing 12 is mounted within a pocket 51 on door outer 52 of glove compartment door 50. Glove compartment door 50 is pivotably mounted to a glove compartment 53 by pin 54 and is movable between a first closed position and a second open position, as shown in FIGS. 4, 9.

A cavity 55 within the interior of glove compartment door 50 is defined by door outer 52 and door inner 56. In order to interconnect door inner 56 and door outer 52, housing 12 is used. The pocket 51 of door outer 52 has an opening for receipt of a rib 57 which projects outwardly from the rear surface 44 of sidewall. 36. When rib 57 is received within the opening in pocket 51 of door outer 52, the outer portion 56 of sidewall 36 extends radially outward of the opening in pocket 51 so as to cover the opening from external view. The outer surface 62 of rib 57 engages the inner surface 64 of the opening in pocket 51 of door outer 52 in order to prevent lateral movement of housing 12 along the outer surface of door outer 52. A pair of self-tapping screws extend through door inner 56 and into screw receipt apertures 47, 49 in projections 46, 48 so as to sandwich the door outer 52 between the outer portion 56 of sidewall 36 and door inner 56.

Figure 8:
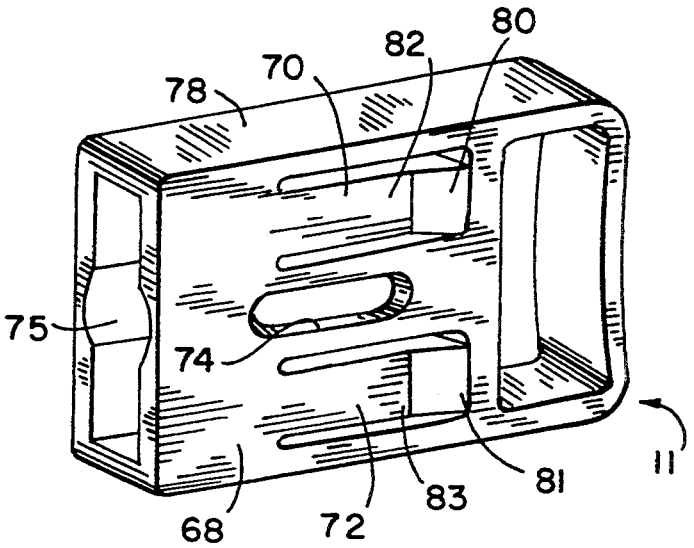
FIG. 8 is an isometric view of the slider of the latch assembly of FIG. 1.

Referring to FIG. 8, slider 11 is provided for receipt within cavity 14 of housing 12. The slider 11 includes a rear sidewall 68 having a pair of track engaging members or projections 70, 72 extending therefrom. Projections 70, 72 align with tracks or slots 38, 40 in housing 12 when slider 11 is received within cavity 14. Similarly, a third slot 74 in slider 11 aligns with slot 42 in housing 12 when slider 11 is received within cavity 14.

As best seen in FIG. 5, in order to interconnect slider 11 to housing 12, spring 26 is inserted into spring receipt cavity 75 and slider 11 is slid laterally into cavity 14 such that the first surface 76 of slider 11 slides along first surface 16 of housing 12; and the second surface 78 of slider 11 slides along second surface 18 of housing 12. As slider 11 is slid into housing 12, tab portions 80, 81 on the outer surface 82, 83 of projections 70, 72 engage the inner surface 84, FIG. 2, of sidewall 36 such that projection 70, 72 are urged toward the interior of slider 11. As each tab portion 80, 81 on the outer surface 82, 83 of each projection 70, 72 engage slots 38, 40 in sidewall 36 of housing 12, the projections 70, 72 are biased toward the exterior of slider 11 such that the tab portions 80, 81 enter slots 38, 40, respectfully, and spring 26 engages spring receipt surface 28. With tab portions 80, 81 in slots 38, 40, slider 11 cannot be slid from housing 12. In order to remove slider 11 from housing 12, projections 70, 72 must be urged toward the interior of slider 11 such that tab portions 80, 81 are removed from within slots 38, 40, thereby allowing slider 11 to be slid from within housing 12.

Figure 1:
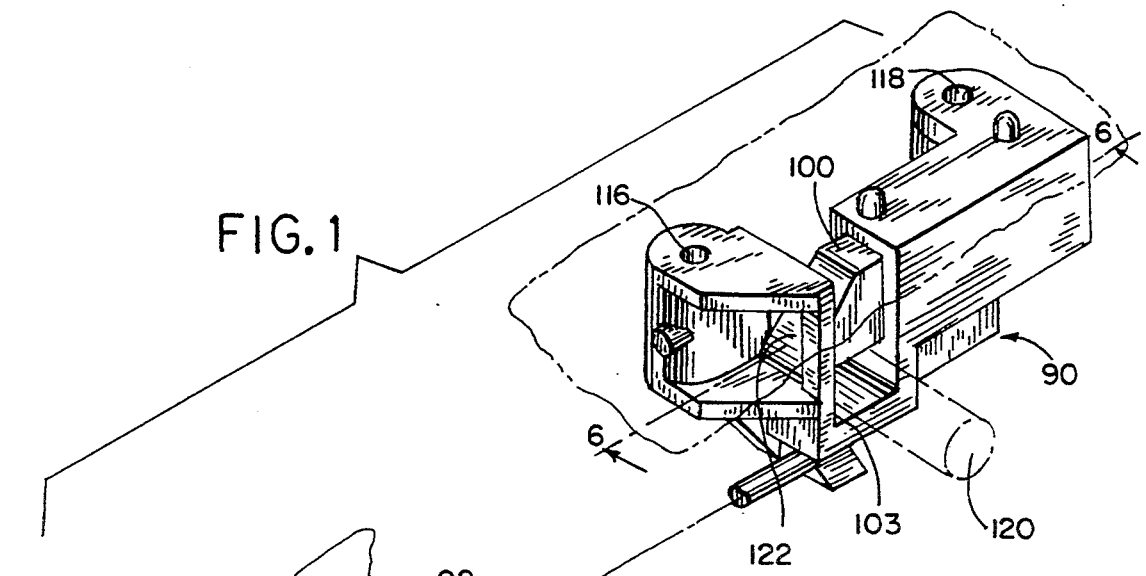
FIG. 1 is an isometric view of the latch assembly of the present invention and a bolt assembly used therewith.
Figure 6:
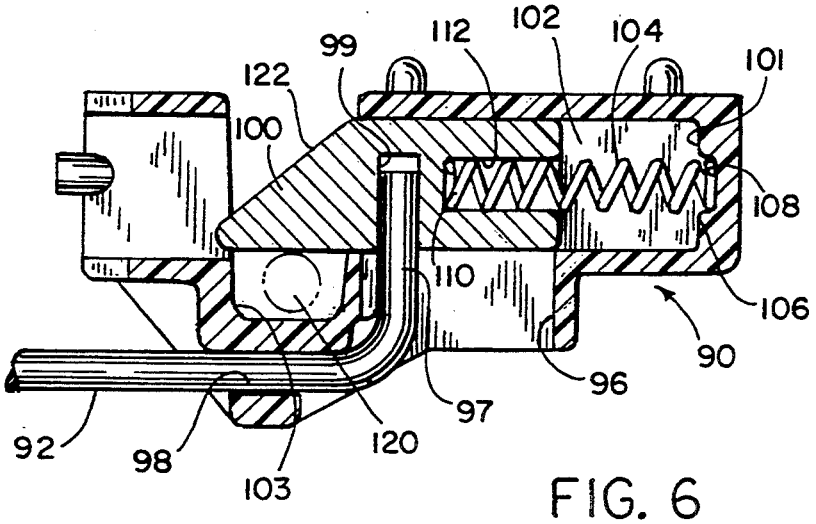
FIG. 6 is a sectional view of the bolt assembly taken along line 6—6 of FIG. 1.

Latch assembly 10 is interconnected to a bolt assembly 90, FIG. 1, by a rod 92. Rod 92 has a first L-shaped end 93 which extends into slider 11 through slot 42 in housing 12 and slot 74 in slider 11, and a second L-shaped end 97 which extends through passageway 98 and chamber 96 in bolt assembly 90 and into a cavity 99 in bolt 100, FIG. 6. Bolt 100 is moveable between a first extended position, as shown in FIG. 6, and a second retracted position which allows access to the interior of striker receipt cavity 103. Bolt 100 is biased toward the first extended position, away from inner surface 101 in cavity 102 of bolt assembly 90, by a spring 104. A first end 106 of spring 104 is received within a groove 108 along surface 101 of bolt assembly 90. A second end 110 of spring 104 extends into a spring receipt cavity 112 in bolt 100. As seen in FIG. 4, bolt assembly 90 is mounted to the inner surface 114 of door inner 56 by a pair of self-tapping screws which extend through door inner 56 and into screw receipt apertures 116, 118 in bolt assembly 90.

Bolt assembly 90 is designed to receive within striker receipt cavity 103 a U-shaped striker element 120 extending outwardly from glove compartment frame 53. In addition, bolt assembly 90 is designed to maintain the striker element 120 within striker receipt cavity 103 when the glove compartment door 50 is in the closed position. Slider 11 is used to actuate the bolt assembly 90 such that bolt 100 moves to the retracted position, thereby allowing bolt assembly 90 to be moved past striker element 120 in order to move the glove compartment door 50 to the open position.

As previously described, the slider 11 is biased by spring 26 away from end surface 20 in cavity 14 of housing 12. In order to actuate bolt assembly 90, slider 11 is urged toward the interior of housing 12, against the bias of spring 26, such that edge 94 of slot 74 engages end 93 of rod 92 and urges end 93 along slot 42 in housing 12, from left to right in FIG. 5. As the first end 93 of rod 92 slides along slot 42 in housing 12, the second end 97 of rod 92 slides along chamber 96 so as to urge bolt 100, against the bias of spring 104, toward the second retracted position.

As slider 11 is squeezed towards the interior of the housing 12 against the bias of spring 26, as described above, bolt 100 moves from the first extended position to the second retracted position. With bolt 100 in the retracted position, bolt assembly 90 may be moved past striker element 120. This, in turn, allows glove compartment door 50 to be moved from the first closed position to the second open position, as shown in FIGS. 4, 9.

After glove compartment door 50 is moved to the open position such that striker element 120 is no longer in striker receipt cavity 103, slider 11 may be released. When slider 11 is released, spring 26 urges slider 11 away from surface 28 within housing 12. As slider 11 is urged away from surface 28, edge 121 of slot 74 engages end 93 of rod 92 so as to slide rod 92 along slot 42 in housing 12, from right to left in FIG. 5. As a result, when slider 11 is released, second end 97 of rod 92 slides along chamber 96, and with spring 104, urges bolt 100 toward the first extended position.

Bolt 100 may also be moved to the second retracted position by exerting a force on sloped surface 122 of bolt 100 such that bolt 100 will be urged against the bias of spring 104. As glove compartment door 50 is closed, striker element 120 engages the sloped surface 122 of bolt 100 such that bolt 100 is urged towards the second retracted position. As bolt 100 is urged toward the retracted position, end 97 of rod 92 slides along chamber 96. This, in turn, causes end 93 of rod 92 to slide along slot 74 in slider 11. As end 93 of rod 92 slides along slot 94 in slider 11, slider 11 is allowed to remain stationary because of the length of slot 74.

As striker element 120 continues to engage sloping surface 122 of bolt 100, bolt 100 is urged closer and closer toward the retracted position until such point as striker element 120 completely enters the striker receipt cavity 103. Bolt 100 is then urged into the extended position by spring 104. This, in turn, allows the user to close glove compartment door 50 without the user squeezing slider 11 into housing 12 so as to move the bolt 100 into the retracted position to allow recapture of striker element 120 within striker receipt cavity 103.

As previously described, in the closed position, a portion of striker 120 is received within striker receipt cavity 103 in bolt assembly 90. Bolt 100, in the first extended position, extends over striker receipt cavity 103 and striker element 120 and between striker legs 126 and 128 such that the striker element 120 may not be removed from the striker receipt cavity 103 and the glove compartment 50 cannot be opened without use of latch assembly 10.

It can be seen through the description of this invention that various embodiments are possible without deviating from the scope and spirit of the invention.

I claim:

1. A latch assembly, comprising:

a hollow housing having a plurality of walls defining a slider-receiving cavity therein, the housing including a first and second parallelly extending guide tracks;

a slider slidably received within the cavity of the housing, the slider slidable between a first non-actuating position and a second actuating position;

first and second resilient projections extending from the slider, each projection movable between a first position wherein a portion of each projection is received within a respective one of the guide tracks, and a second position wherein the portion of each projection is removed from the guide tracks; and means for biasing the slider toward the first non-actuating position.

2. The latch assembly of claim 1, wherein the guide track includes first and second slots extending through a portion of the housing.

3. The latch assembly of claim 1, wherein the means for biasing the slider toward the first non-actuating position includes a spring.

4. A latch assembly for actuating a bolt assembly of a door, comprising:

a generally rectangular hollow housing having first and second wall portions interconnected by side walls, the wall portions and the side walls defining a slider-receiving cavity within the housing;

a slider partially extending into the cavity of the housing, the slider slidable between a first non-actuating position and a second actuating position;

a guide track extending along the housing, the guide track including first and second parallelly extending slots extending along the first wall portion;

first and second resilient projections extending from the slider, each projection including a tab movable between a first position wherein the tab extends into one of said slots and the slider is maintained in the cavity of the housing, and a second position wherein the tab is removed from said one slot; and means for biasing the slider toward the first non-actuating position.

5. The latch assembly of claim 4, wherein the means for biasing the slider towards the first non-actuating position includes a spring.

6. The latch assembly of claim 4, further comprising a means for interconnecting the housing to the door.

7. The latch assembly of claim 4, wherein the means for interconnecting the housing to the door includes one or more screws extending through the door and into the first wall portion of the housing.

8. The latch assembly of claim 4, further comprising a rod interconnecting the slider to the bolt assembly, the rod movable in response to the sliding of the slider between the first non-actuating and the second actuating position so as to actuate the bolt assembly.

9. A squeeze latch assembly for actuating a bolt assembly of an automobile glove compartment door, comprising:

a hollow housing having a plurality of walls defining a slider-receiving cavity therein;

a slider slidably received within the cavity of said housing, said slider slidable between a first non-actuating position wherein one end of said slider projects from said housing and a second actuating position wherein said one end of said slider retracts within said housing;

a slider spring for biasing said slider toward the non-actuating position;

an actuator for unlocking a remote bolt assembly of a door, said actuator movable between a bolt locking position and a bolt unlocking position;

a bolt spring for biasing said actuator toward the bolt locking position; and mounting means for mounting said actuator for independent movement with respect to said slider so that movement of said slider from said first non-actuating position to said second actuating position causes movement of said actuator from said bolt locking position to said bolt unlocking position, but movement of said actuator independently of said slider from said bolt locking position to said bolt unlocking position does not cause corresponding movement of said slider.

10. A squeeze latch assembly of claim 9 further comprising:

a guide track extending along the interior of said housing, said guide track including first and second parallelly extending slots, and first and second resilient projections extending from said slider, each projection including a tab movable between a first position wherein the tab extends into one of said slots and the slider as maintained in the cavity of the housing, and a second position wherein the tab is removed from said one slot.

11. The squeeze latch assembly of claim 9 wherein said actuator includes a rod.

12. A closure mechanism for a door of a glove compartment, comprising:

a housing interconnected to the door of a glove compartment, the housing having a cavity extending partially therein;

a guide track extending along the housing;

a slider partially received within a cavity of the housing, the slider slidable between a first non-actuating position and a second actuating position;

a track engaging member extending from the slider, the track engaging member engaging the guide track and maintaining the slider within the cavity of the housing;

a bolt assembly having a bolt movable between a first non-actuating position and a second actuating position, the bolt interconnected to the slider by a rod such that the bolt is movable between the first non-actuating position and the second actuating position in response to the sliding of the slider between the first non-actuating position and the second actuating position; and a striker extending from the glove compartment.

13. The closure mechanism of claim 12, wherein a portion of the striker is maintained within the bolt assembly when a door is closed and the bolt assembly is in the non-actuating position.

14. A closure mechanism for a door of a glove compartment, comprising:

a housing interconnected to the door of a glove compartment, the housing having a cavity extending partially therein;

a guide track extending along the housing;

a slider partially received within a cavity of the housing, the slider slidable between a first non-actuating position and a second actuating position;

a track engaging member extending from the slider, the track engaging member engaging the guide track and maintaining the slider within the cavity of the housing;

a bolt assembly having a bolt movable between a first non-actuating position and a second actuating position, the bolt interconnected to the slider by a rod such that the bolt is movable between the first non-actuating position and the second actuating position in response to the sliding of the slider between the first non-actuating position and the second actuating position.

15. The closure mechanism of claim 14 further comprising a means for biasing the slider towards the first non-actuating position.

16. The closure mechanism of claim 15 wherein the means for biasing the slider includes a spring.

17. The closure mechanism of claim 14 further comprising a means for biasing the bolt toward a first non-actuating position.

18. The closure mechanism of claim 17 wherein the means for biasing the bolt includes a spring.

* * * * *